United States Patent [19]

Forbes Jones et al.

[11] 4,016,008

[45] Apr. 5, 1977

[54] CLAD METAL TUBES

[75] Inventors: Robin Mackay Forbes Jones, Titusville; Walter Adrian Petersen, Ridgewood, both of N.J.

[73] Assignee: The International Nickel Company, Inc., New York, N.Y.

[22] Filed: July 31, 1975

[21] Appl. No.: 600,613

[52] U.S. Cl. ..... 138/140; 148/11.5 Q; 148/12 R; 148/11.5 P; 428/678

[51] Int. Cl.[2] ..... B22F 7/04

[58] Field of Search ..... 75/208, 214, 226; 29/420.5, 191; 148/11.5 P, 11.5 Q, 34, 12 R; 138/143

[56] References Cited

UNITED STATES PATENTS

| | | | |
|---|---|---|---|
| 3,652,235 | 3/1972 | Manilla et al. | 29/194 |
| 3,753,704 | 8/1973 | Manilla et al. | 75/208 R |
| 3,803,702 | 4/1974 | Bratt et al. | 29/420.5 |
| 3,834,003 | 9/1974 | Nayar | 29/420.5 |

*Primary Examiner*—W. Stallard

*Attorney, Agent, or Firm*—Walter A. Petersen; Ewan C. MacQueen; Raymond J. Kenny

[57] ABSTRACT

A method for producing high strength composite tubing having a corrosion-resistant metal lining. The composite tubing is prepared by extrusion of an assembly having a low alloy steel outer shell and metal powder lining. The metal powder is consolidated during extrusion and high strength is attained by heat treatment.

18 Claims, 1 Drawing Figure

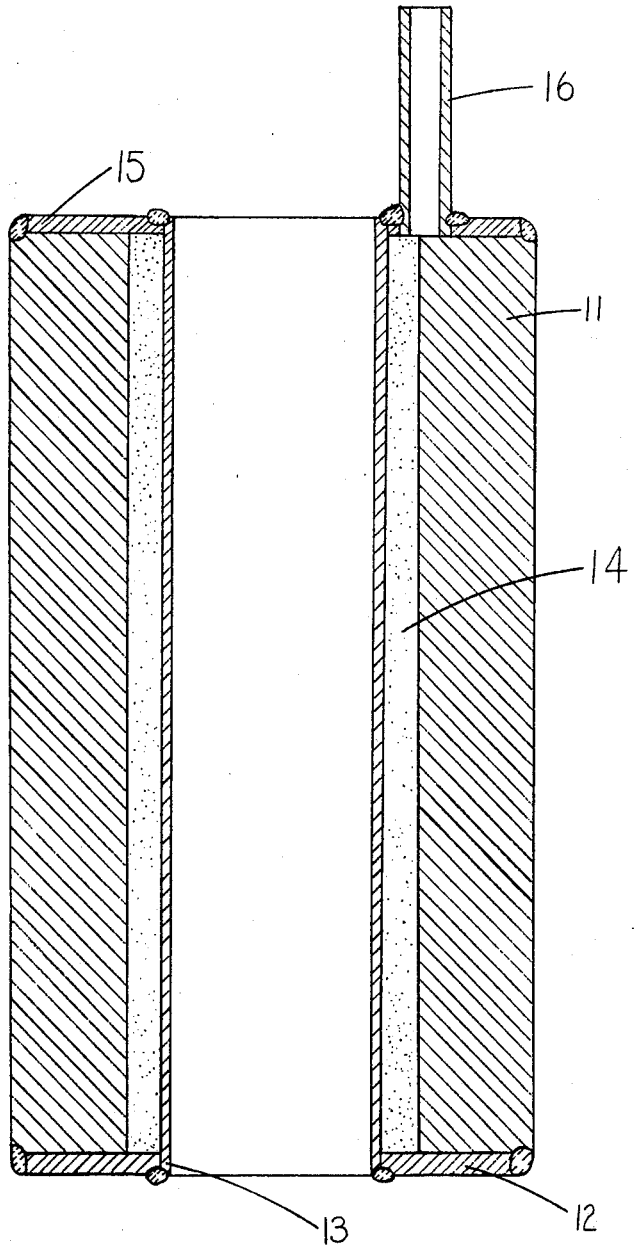
16
15
11
14
13
12

CLAD METAL TUBES

The invention is directed to the production of high-strength composite tubing having a corrosion-resistant metal lining.

A need exists for high-strength, corrosion-resistant tubular goods for applications such as those involving the recovery of petroleum from deep sour wells. There are only a few metals having suitable resistance to the severe corrosive environment and 400° to 600° F temperature found in these wells. Typically sour wells may contain about 35% hydrogen sulfide, 10% carbon dioxide, brackish water and have a pH of 3. In addition, chloride ions may be present in the brackish water as sodium chloride in concentrations of 5% or even 10%. Because such wells may be as deep as 20,000 or even 30,000 feet, the tubing must have very high strength, e.g., more than 13,000 psi yield strength, in order to support its own weight. Nickel-containing alloys which possess suitable corrosion-resistance, do not have the strength required for such applications unless severely cold-worked. Such cold working operations entail considerable expense and it would be highly advantageous to produce useful tubing by an alternative method at lower cost. Such an alternative is a composite tube having a heat-treatable, high-strength steel outer shell and a corrosion-resistant nickel-base alloy inner liner.

It would appear at first glance that the production of such an internally clad tube could be accomplished by a variety of known techniques. However, experimentation has shown that present-day processes are unsatisfactory for several reasons.

To illustrate, in an extrusion process in which a billet composed of a low-alloy steel outer shell closely fitted to a wrought nickel-base alloy liner is heated to the extrusion temperature and reduced in cross section by passing through an extrusion die and over a mandrel, buckling occurs in the liner while tearing occurs in the steel shell due to major differences in the hot working characteristics of ferrous and non-ferrous alloys.

In the method of preparing a nickel-base alloy liner from metal powder sintered prior to insertion within a metal shell described in U.S. Pat. No. 3,753,704, extensive precision machining is required of both the liner and the steel shell. Due to the large size required for extrusion billets suitable for the present and other applications, extensive fit-up problems can be encountered. Furthermore, it is advantageous to reduce the number of separate operations and equipment required by this process.

Weld overlay and plasma-sprayed coatings have also been considered as potential methods for internal coating of low-alloy, high-strength steel tubing; however, application of these processes is limited by a geometric consideration, namely, access to the inside of the tubing by the welding or plasma-spraying equipment. Furthermore, thick coatings prepared by weld overlaying on the inside surface of large diameter extrusion billets are subject to the same problem as aforedescribed for solid tubing inserts in a metal shell and, plasma-sprayed coatings are too thin and probably not dense enough for the intended severely corrosive environment.

We have now discovered a powder metallurgy process for producing heat-treatable, high-strength, corrosion-resistant, composite tubing having a metal outer shell, e.g., alloy steel, and a dense metal liner made from metal powder capable of conferring enhanced resistance to corrosion, e.g., a nickel-base alloy.

It is an object of the present invention to provide high-strength composite tubing with a corrosion-resistant inner liner that is less expensive to produce than solid, cold-work-strengthened corrosion-resistant tubing.

It is another object of the invention to provide an improved powder metallurgy technique for the production of high-strength, corrosion-resistant composite tubing.

It is still another object of the invention to provide an easily extrudable and heat-treatable composite tube having ferrous and non-ferrous members.

Other objects and advantages of the invention will become apparent from the following description taken in conjunction with the accompanying drawing in which:

FIG. 1 is a cross-sectional view of an extrusion assembly prior to extrusion.

Generally speaking, the present invention is directed to a process for preparing a composite metallic tubular member having an internally-lined metal surface comprising preparing a metal shell having concentric inner and outer surfaces; attaching to said metal shell a first end closure plate and a metal inner liner so that said metal shell and said metal inner liner are concentrically aligned thereby forming an annular space; pouring a metal powder into said annular space between said metal shell and said metal inner liner; attaching to said metal shell and said metal inner liner a second end closure plate thereby enclosing said annular space containing said metal powder and completing an extrusion assembly; heating said assembly for a time period sufficient to substantially through-heat said assembly to a temperature substantially corresponding to the extrusion temperature to be employed; and extruding said assembly through an extrusion die to produce said composite metallic tubular member having an internally-lined metal surface.

Although such sealed extrusion assemblies may be readily extruded to composite metallic tubular members, it is preferred to subject the metal powder contained within the annular space between the metal shell and inner metal liner to a vacuum in order to substantially remove entrained air. This is accomplished by including an evacuation means, e.g., a tube, having access to the annular space. A vacuum is then drawn through the evacuation tube until a vacuum of the desired level, preferably down to about 10 to 20 microns, is obtained. It has been found advantageous to heat the assembly to temperatures in excess of about 250° F during vacuum treatment. This aids in minimizing any moisture entrained in the metal powder. Once the desired vacuum has been established, the tube is heated to a red heat, crimped in two places and welded to seal the assembly from the atmosphere.

Creation of a vacuum within the annular space substantially lowers the degree of oxidation of the metal powder thereby promoting sintering and limiting the inclusion of oxide particles within the coating. The vacuum also avoids build-up of pressure within the extrusion assembly during heating due to expansion of entrained air. Such pressure could lead to deformation and buckling of the inner liner.

The invention also contemplates that problems inherent with oxidation and buckling of the inner liner may be overcome in an extrusion assembly, possibly not subjected to vacuum, by use of a small quantity of a "getter", such as titanium-sponge, contained within at least one end of the assembly.

Consideration of the drawing of an extrusion assembly shown in FIG. 1 serves to provide a clearer understanding of the process of this invention. The assembly is formed by joining, preferably by welding, a metal shell 11 to a first end closure plate 12 and a metal inner liner 13. A metal powder 14 is poured into the annular space formed between the metal inner liner and metal shell. A second end closure plate 15 is then welded to the metal shell and the inner liner, thereby sealing the extrusion assembly from the atmosphere. The assembly advantageously contains an evacuation means in the form of a tube 16 which is used to remove entrained air from the metal powder and thereafter sealed. The completed assembly is heated to the desired temperature and extruded conventionally to form a composite metallic tubular member.

The metal used for the shell will normally be of an alloy steel and should be selected to provide the appropriate properties desired in the finished composite metallic tubular member. A heat-treatable alloy is preferred that can be hardened by standard quench and temper procedures. An example of a low-alloy, high-strength steel useful in fabricating the metal shell is one containing up to about 0.4% carbon, up to about 0.2% silicon, up to about 2% manganese, up to about 1% molybdenum, up to about 0.1% vanadium, up to about 0.2% aluminum and the balance essentially iron. Other more highly alloyed steels such as maraging steels may also be employed in situations requiring high toughness in addition to high strength. For applications involving somewhat higher temperatures, other steels such as those containing 2¼% chromium and 1% molybdenum may be used. The steel may be in cast or wrought form. Billets, suitable for use in the extrusion assembly, can be cast, possibly in tubular form, or machined from wrought or cast solid or tubular stock, preferably seamless tubing. In this regard, it is preferred that the steel selected have a high degree of machinability. Although a steel outer shell is preferred, it is apparent that another metal, such as a stainless steel or a high-nickel alloy, could be used for the outer shell.

The shell should be prepared in such a manner that the outer and inner surfaces will be concentric and thereby the extruded tubular member will also exhibit concentricity. Prior to joining the metal shell to the first end closure plate, the surfaces should be thoroughly cleaned to remove dirt, oil and rust so that extraneous impurities do not contaminate the powder and prevent effective sintering of the metal powder to itself and to the metal shell. It is preferred that the shell, liner, first end closure plate and second end closure plate be prepared from alloys that are readily weldable and provide sound joints free from cracking since such cracks as well as other defects in the welds might lead to contamination of the contained metal powder.

Virtually, any metal powder can be introduced to the annular space between the shell and the inner metal liner, provided that the melting temperature of the metal powder is above the effective extrusion temperature required for the shell. Also, the metal powder must be capable of forming a metallurgical bond to the shell.

Since the process of this invention is particularly suited to metals that are difficult to prepare by extrusion, it is preferred to use a difficult to extrude metal powder for the coating material since it would be otherwise possible to use different methods for preparing the desired composite metallic tubular member. Generally, for corrosion resisting applications, it is preferred that the difficult to extrude metal be a nickel-containing material. However, the use of metal powders suited for wear-resistant applications is also contemplated by this invention. Preferred alloy powders contain, in addition to nickel, from about 10% to about 30% chromium, up to about 40% cobalt, up to about 20% iron, up to about 20% molybdenum, up to about 10% tungsten, up to about 10% columbium, up to about 5% titanium, and up to about 3% aluminum. An example of a specific preferred metal powder is one containing: up to about 0.1% carbon, up to about 0.5% silicon, up to about 0.5% manganese, from about 20% to about 23% chromium, from about 8% to about 10% molybdenum, from about 3% to about 4% columbium, up to about 0.4% aluminum, up to about 0.4% titanium, up to about 5% iron, and the balance essentially nickel.

Although metal powders may be prepared by various means, it has been found that pre-alloyed powders are preferred, although mixtures of elemental powders may be used. The preferred method for preparing pre-alloyed powders is by vacuum-melting and atomizing with argon so that a powder substantially free from surface oxides and nitrides is obtained. Water or argon atomization of air-melted heats is also contemplated and is useful for metals having less reactivity than the afore-described preferred nickel-containing alloy.

Powder should be preferably screened to a U.S. Sieve Series size of minus 100 to remove excessively large particles. It has been found particularly advantegeous to use a powder with a sieve size below 100 and above 325. The metal powder should be highly flowable so that it may be easily introduced to the annular space between the metal shell and inner liner. This is particularly important where it is desired to obtain maximum filling of the annular space.

Although it is advantageous to have the maximum quantity of powder obtainable within the annular space, consolidation of the metal powder is not required prior to extrusion. Furthermore, when the metal insert material has 100% density, i.e., in the case of a solid wrought tubing insert, buckling of the insert and tearing of the metal shell occurs. Thus, it is to advantage to have a metal insert material with less than 100% density.

The materials selected for the liner, end closure plates and evacuation means should be compatible with the extrusion process. Because air-tight construction is desired, these materials should possess a high degree of weldability so that they may be joined to each other and to the metal shell.

Metals that rapidly form oxide scales in the soaking furnace atmosphere should be avoided during the required holding period prior to extrusion since penetration of the assembly with consequent lack of protection to the atmosphere could occur. Furthermore, the presence of heavy oxide scale can lead to the formation of rough and uneven internal surfaces. Such roughness and unevenness can cause penetration of the corrosion-resistant liner even prior to service.

Mild steel has been found to be a preferred material for construction of the liner, end closure plates and evacuation tube. This inexpensive material generally affords sufficient oxidation-resistance in a protective atmosphere for the soaking treatment required before extrusion. Also, the scale that forms during soaking is not sufficiently coarse nor is it sufficiently hard to create surface roughness and unevenness in the finished tube. For severely oxidizing conditions or extremely long soaking periods, nickel, stainless steels, and similar oxidation-resistant alloys have been found to be useful as liners, end closure plates and evacuation means.

Following extrusion, the metal liner remains behind on the inside of the tubular member. Although such residual metal may not be entirely undesirable since it can conceivably act to cathodically protect the lining formed from metal powder and thereby be removed in service, it may also be removed preferably by dissolving in an acid solution or by machining before service.

It is deemed most beneficial that the extrusion temperature be compatible with the extrusion characteristics of the outer shell and about 85% of the melting point of the metal powder. For ferrous alloys, such as high-strength, low-alloy steels, soaking in the temperature range 1800° to 2200° F is useful and a soaking temperature of about 2000° F is preferred. The composite billets should be soaked for a time period sufficient to through-heat them. A soaking time of about four hours at 2000° F has been found suitable for composite billets having an 8¾ inches outside diameter.

To avoid settling of the powder while the billets are held in the horizontal position during transportation, soaking and extrusion; it has been found that powder may be kept uniformly in place within the annular space by initial heating of the assembly in the upright position. The initial sintering of the powder during this operation substantially reduces the possibility of unlined areas within the tube.

The rate at which the composite tube is extruded has been found to be important. Extrusion at slow speeds may cause substantial reduction in billet temperature which can lead to the need for excessively high extrusion pressures and the possibility of extrusion stoppage. These deleterious effects can cause rejection and excessive scrap loss. Excessively rapid extrusion rates can lead to the formation of defective tubing since, for example, both the metal shell and the consolidated powder may co-extrude on one side of the die. Extrusion at ram speeds of about 1½ inches per second have been found to be useful for an 8¾ inches O.D. composite tube. It is generally preferred that the ram speed be between about ½ and about 8 inches per second. In addition, the extrusion ratio for composite billets should be between about 5:1 and 25:1. Extrusion ratios of about 12:1 have been found useful in practice.

The width of the annular space between the inner metal liner and metal shell should be proportioned to the thickness of the metal shell so that after extrusion, the resultant lining will be of appropriate thickness to provide useful corrosion resisting life, yet, not so thick as to detract substantially from the overall strength of the tubing. For example, it has been found particularly useful in a 7¾ inches O.D., 4¾ inches I.D. billet to use an annular space width of about ¾ inch to provide a coating thickness of about 0.020 inch in a 2⅞ inches O.D., 3/16 inch wall extruded tube.

Following the optional and previously described inner liner removal portion of the process, particularly when acids have been used, it is preferred to heat-treat the composite metallic tubular member to provide the required high strength. For shells made from low-alloy steel, a quench and temper heat treatment is preferred. This can be accomplished by heating to temperatures of about 1500° to 1800° F and preferably about 1650° F for about ½ to about 3 hours and water quenching. Thereafter, the member is given a tempering heat treatment for about ½ to about 10 hours at temperatures from about 400° to about 1200° F, which although lowering strength somewhat, substantially increases ductility and toughness. Other heat treatments commonly known to be used for specific steels are also contemplated as being within this invention.

For the purpose of giving those skilled in the art a better understanding of the invention, the following illustrative examples are given:

EXAMPLE I

This example illustrates the method of preparing a composite metallic tubular member having a steel shell and an internal nickel-base alloy lining formed from metal powder, wherein the metal powder is subject to a vacuum prior to and during extrusion.

The steel shell was prepared from an air-induction melted 100-lb. heat of a low-alloy, high-strength steel containing 0.22% C, 0.17% Si, 1.22% Mn, 0.37% Mo, 0.058% V, 0.04% Al, balance Fe. The heat was poured into a 4 inches diameter by 21 inches high green-sand mold having a conical hot top. This ingot was machined to provide 3½ inches diameter by 6 inches long extrusion billets having a 1.92 inches diameter center hole. A machined billet was cleaned to remove all traces of extraneous matter and welded to a ⅛ inch thick mild steel first end closure plate which was welded to a 1½ inches inside diameter, 0.062 inch wall nickel tube which served as an inner liner. The first end closure plate and inner liner were concentrically aligned with the low-alloy steel shell. The metal powder used to produce the internally lined metal surface was prepared by argon atomization of a vacuum melted 300-lb. heat of the composition shown in Table I.

TABLE I

| Composition of Metal Powder in Weight Percent, Balance Nickel | | | | | | | | |
|---|---|---|---|---|---|---|---|---|
| C | Si | Mn | Cr | Mo | Cb | Al | Ti | Fe |
| 0.06 | 0.35 | 0.11 | 21.5 | 8.7 | 4.2 | 0.32 | 0.20 | 4.5 |

The powder was screened to remove particles having a U.S. Sieve Series size greater than 100 and smaller than 325. It was poured into the annular space between the steel shell and the inner liner. The ⅛ inch thick mild steel second end closure plate was welded to an evacuation means which was a 7/16 inch diameter, 0.065 inch thick wall, mild steel tube. The second end closure plate was concentrically aligned and then attached by welding to the metal inner liner and the steel shell thereby completing the extrusion assembly.

The extrusion assembly was heated to 250° F using external heating strips while connected by a heavy-walled rubber hose to a rotary mechanical vacuum pump. The assembly was pumped down for 2 hours to a pressure of about 15 microns. While still connected to the vacuum system, two areas on the 5 inches long steel evacuation tube were heated to a red heat with an oxyacetylene torch and crimped shut. The hose leading to the vacuum system was disconnected and the crimped area furthest from the extrusion assembly was reheated until it fused together thereby sealing the extrusion assembly.

The assembly was soaked in the upright position for 2 hours at 2000° F in a furnace having an argon atmosphere. Upon removal from the furnace it was immediately extruded to 1½ inches inside diameter, ⅛ inch wall tubing using glass wool lubrication on the outer die surface and conventional lubricant on the mandrel. The ram speed during the extrusion operation was about 5 inches per second.

The extruded tube was about 6 feet long and had a concentric internally lined metal surface. Measurements of representative cross-sections of the extruded tubing showed that the coating thickness ranged from 0.012 inch to 0.015 inch in thickness. The tubing produced was of good concentricity and the cross-sectional thickness ranged from 0.128 inch to 0.132 inch. Longitudinal inch. of the tubing showed that there was uniform coating in this direction as well. Measurements of coating thickness and tubing width were found to be equivalent to those determined for the transverse cross-sections. There was some galling of the nickel liner by the mandrel, However, the nickel liner was not penetrated.

The tensile properties of the composite tube were determined after a variety of heat treatments on strip tensile coupons cut with their length paralleling the longitudinal axis of the tube, spanning about ⅛ of the tube circumference and having a full cross-section. The results of these tests contained in Table II showed that yield strength well in excess of 130,000 psi was obtained in the composite material. A heat treatment consisting of ½ hour at 1650° F followed by water quenching and thereafter tempering for 1 hour at various temperatures produced the required high strength.

TABLE II

Tensile Properties of Internally Clad Steel Tube

| Tempering Treatment following 1/2 hr. at 1650° F, water quench heat treatment | 0.2% Y.S., psi | U.T.S., psi | El. in 1", % |
|---|---|---|---|
| 1 hour at 400° F | 178,800 | 218,100 | 10.0 |
| 1 hour at 600° F | 160,200 | 178,300 | 8.0 |
| 1 hour at 700° F | 150,400 | 161,200 | 8.5 |
| 1 hour at 1000° F | 138,400 | 150,600 | 11.0 |

EXAMPLE II

This example illustrates the method of preparing a composite metallic tubular member having a steel shell and an internal nickel-base alloy lining formed from metal powder, wherein the metal powder is sealed from contact with air yet is not evacuated prior to and during extrusion.

An extrusion assembly was prepared using the procedure described previously in Example I, except that neither end closure plate had an evacuation tube and the completed assembly was not subjected to vacuum. The metal shell was prepared from an air induction melted 100-lb. heat of low-alloy, high-strength steel which had been cast into a 4 inches round by 21 inches long green-sand mold. The steel shell contained 0.125% carbon, 0.17% silicon, 1.48% manganese, 0.36% molybdenum and the balance iron.

The 3½ inches diameter by 6 inches long assembly was soaked in the upright position for 2 hours at 2000° F in a furnace having an air atmosphere. The assembly was extruded at a ram speed of about 5 inches/sec., and the extruded tube produced was about 6 feet long. The 1½ inches inside diameter, ⅛ inch wall tubing had a coating thickness ranging from 0.012 inch to 0.018 inch. Microsopic examination of this coating showed the presence of numerous stringer-like oxide inclusions. These inclusions were cylindrical in cross-section, ran longitudinally and were not interconnected. Because of the shape and distribution of the inclusions, it is anticipated that no problem would arise in the proposed sour oil well service. In such service, strength reduction associated with the inclusions would be minimal. Also, the load stemming from the weight of the tubing, since the internal load is minimal, would be directed parallel to the orientation of the inclusions and would not be subject to potential notch sensitivity. Despite the fact that the tubing produced by this method was satisfactory, it is still preferred to evacuate the annular space between the inner liner and metal shell since the vacuum aids in avoiding excessive oxidation, i.e., rusting, within the extrusion assembly during prolonged storage which could lead to incomplete bonding.

EXAMPLE III

A third extrusion assembly was prepared in the manner described for Example I, using the +100, −325 U.S. Sieve Series nickel-base alloy powder of the composition described in Table I. The metal shell in this assembly had an 8¾ inches outside diameter, was 17 inches long and had a 4¾ inches diameter center hole. The steel used for the metal shell was the product of a 300-lb. air-induction melt. It was poured into a green-sand mold and contained: 0.19% C, less than 0.1% Si, 1.09% Mn, 0.1% Mo, 0.065% V, balance Fe. The metal liner was S.A.E. 1015 seamless steel tubing with a 3¼ inches outside diameter and ¼ inch thick wall. The ¼ inch end closure plates and the 7/16 inch diameter, 0.065 inch thick wall evacuation tube were mild steel.

The assembly was subjected to a vacuum of about 15 microns and sealed in the manner described previously under Example I. The assembly was not sintered prior to extrusion but was charged in the horizontal position into a furnace having an air atmosphere for about 4 hours at 2000° F. The assembly was removed from the furnace and immediately extruded over a 2½ inches diameter mandrel at a ram speed of 1.5 inches per second. The resultant tubing was about 39 feet long. Some eccentricity of the lining near one end was noted during sectioning. This eccentricity was attributed to the lack of a sintering treatment in the vertical position prior to soaking. Measurements made on transverse and longitudinal sections of the tube showed that the front and middle portions of the tube ranged in thickness from 0.157 inch to 0.198 inch, and that the lining thickness ranged from 0.013 inch to 0.026 inch. There was no penetration of the lining by the relatively soft oxide scale formed from the mild steel components whereas this type of defect has been observed in other tests, not reported herein, on composite tubing prepared with an inner liner subject to the formation of heavy oxide scale.

Since the inner liner in this extrusion was made from mild steel, a representative section of the extrusion was fitted at one end with a rubber plug. The tube was held in the upright position and contacted with a 10% nitric acid solution for about ½ hour at room temperature. After the acid solution was removed and the surface washed with water, examination showed that the steel inner liner had dissolved. The inner surface of the tube was completely sound, uniformly smooth and free from penetration to the steel outer shell.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A process for preparing a composite metallic tubular member having an internally-lined metal surface comprising: preparing a metal shell having concentric inner and outer surfaces; attaching to said metal shell a first end closure plate and a metal inner liner so that said metal shell and said metal inner liner are concentrically aligned, thereby forming an annular space; pouring a pre-alloyed, argon atomized metal powder into said annular space between said metal shell and said metal inner liner; attaching to said metal shell and said metal inner liner a second end closure plate thereby enclosing said annular space containing said metal powder and completing an assembly; heating said assembly for a time period sufficient to substantially through-heat said assembly to a temperature substantially corresponding to the extrusion temperature to be employed; and extruding said assembly through an extrusion die to produce said composite metallic tubular member having an internally-lined metal surface.

2. A process as defined in claim 1 wherein said first end closure plate or said second end closure plate contains an evacuation means.

3. A process as defined in claim 2 wherein entrained air is removed from said metal powder contained within said annular space through said evacuation means, and thereafter said evacuation means is sealed.

4. A process as defined in claim 1 wherein said extrusion assembly is heated in an upright position thereby providing an initial sintering operation of said metal powder to minimize settling of said metal powder during movement entailed in transporting and loading said extrusion assembly into an extruder.

5. A process as defined in claim 1 wherein said metal shell is a high-strength steel.

6. A process as defined in claim 5 wherein said high-strength steel contains up to about 0.4% carbon, up to about 0.2% silicon, up to about 2% manganese, up to about 1% molybdenum, up to about 0.1% vanadium, up to about 0.2% aluminum and the balance essentially iron.

7. A process as defined in claim 1 wherein said metal powder is a nickel-base alloy.

8. A process as defined in claim 7 wherein said metal powder contains from about 10% to about 30% chromium, up to about 40% cobalt, up to about 20% iron, up to about 20% molybdenum, up to about 10% tungsten, up to about 10% columbium, up to about 5% titanium, up to about 1% aluminum, and the balance essentially nickel.

9. A process as defined in claim 8 wherein said metal powder contains up to about 0.1% carbon, up to about 0.5% silicon, up to about 0.5% manganese, from about 20% to about 23% chromium, from about 8% to about 10% molybdenum, from about 3% to about 4% columbium, up to about 0.4% aluminum, up to about 0.4% titanium, up to about 5% iron, and the balance essentially nickel.

10. A process as defined in claim 1 wherein said metal inner liner, said first end closure plate and said second end closure plate are mild steel.

11. A process as defined in claim 1 wherein said metal shell, said metal inner liner, said first end closure plate and said second end closure plate are joined together by welding.

12. A process as defined in claim 1 wherein said extrusion assembly is heated to about 1800° F to about 2200° F prior to extrusion.

13. A process as defined in claim 1 wherein said metal inner liner is removed from said composite metallic tubular member by pickling.

14. A process as defined in claim 1 wherein said composite metallic tubular member is heated for about ½ hour to about 3 hours at about 1500° to about 1800°F, followed by water quenching and then heated for about ½ hour to about 10 hours at about 400° to about 1200° F.

15. A process as defined in claim 1 wherein said metal powder is highly flowable and has a sieve size below 100 and above 325.

16. A high-strength, corrosion-resistant composite metallic tubular member consisting of: a low alloy steel outer shell containing up to about 0.4% carbon, up to about 0.2% silicon, up to about 2% manganese, up to about 1% molybdenum, up to about 0.1% vanadium, up to about 0.2% aluminum, and the balance essentially iron and a nickel-base alloy inner lining containing from about 10% to about 30% chromium, up to about 20% iron, up to about 20% molybdenum, up to about 10% tungsten, up to about 10% columbium and the balance essentially nickel.

17. A tubular member as defined in claim 16 wherein said nickel-base alloy inner lining contains up to about 0.1% carbon, up to about 0.5% silicon, up to about 0.5% manganese, from about 20% to about 23% chromium, from about 8% to about 10% molybdenum, from about 3% to about 4% columbium, up to about 0.4% aluminum, up to about 0.4% titanium, up to about 5% iron, and the balance essentially nickel.

18. A tubular member as defined in claim 17 wherein a yield strength in excess of about 130,000 psi is attained after heating for about ½ hour to about 3 hours at temperatures from about 1500° F, followed by water quenching and then reheating for about ½ hour to about 10 hours at temperatures from about 400° to about 1200° F.

* * * * *